United States Patent [19]

Brusky et al.

[11] 4,438,009

[45] Mar. 20, 1984

[54] LOW SOLVENT LAUNDRY PRE-SPOTTING COMPOSITION

[75] Inventors: Jeanne A. Brusky; Rodney W. Schrader, both of Racine County, Wis.

[73] Assignee: S. C. Johnson & Son, Inc., Racine, Wis.

[21] Appl. No.: 293,049

[22] Filed: Aug. 14, 1981

[51] Int. Cl.[3] ..... C11D 1/72; C11D 1/825; C11D 3/04; C11D 3/42

[52] U.S. Cl. ..... 252/90; 252/139; 252/170; 252/171; 252/173; 252/174.14; 252/174.18; 252/174.21; 252/174.22; 252/DIG. 1; 252/DIG. 14

[58] Field of Search ..... 252/139, 170, 171, 173, 252/174.11, 174.21, 174.22, DIG. 1, DIG. 14, 90

[56] References Cited

U.S. PATENT DOCUMENTS

| | | | |
|---|---|---|---|
| 4,123,378 | 10/1978 | Abel | 252/171 |
| 4,176,080 | 11/1979 | Wise | 252/162 |
| 4,180,472 | 12/1979 | Mitchell | 252/162 |
| 4,247,424 | 1/1981 | Kuzel | 252/528 |
| 4,263,284 | 4/1981 | Schreuder | 252/171 |
| 4,288,339 | 9/1981 | Wilsberg | 252/90 |
| 4,336,152 | 6/1982 | Like | 252/106 |

FOREIGN PATENT DOCUMENTS

| | | | |
|---|---|---|---|
| 579116 | 7/1959 | Canada | 252/139 |
| 890567 | 3/1962 | United Kingdom | 252/139 |

*Primary Examiner*—Dennis L. Albrecht

[57] ABSTRACT

An emulsion pre-spotting composition having superior effectiveness against both oil-borne and water-borne stains utilizing a relatively low amount of solvent and a mixture of nonionic surfactants.

16 Claims, No Drawings

LOW SOLVENT LAUNDRY PRE-SPOTTING COMPOSITION

BACKGROUND

This invention relates to aqueous laundry pre-spotting compositions. More particularly, this invention relates to an aqueous emulsion pre-spotting composition containing a relatively low amount of solvent, having superior cleaning and stain removal properties.

Currently, commercially available pre-spotting compositions fall into two categories: aqueous-based and solvent-based. The aqueous-based pre-spotting compositions are primarily non-aerosol formulations dispensed from trigger spray bottles or squeeze bottles onto the fabrics before they are laundered. Typically, aqueous-based pre-spotting compositions have good stain removal characteristics against so-called "water-borne" stains. These stains include a variety of stains, such as grape juice, mustard, spaghetti sauce, grass, chocolate, clay and similar stains.

The solvent-based formulations typically have been packaged in aerosol form. The solvent-based pre-spotting compositions typically are more effective in removing "oil-borne" stains, such as cooking oil, fat, sebum, grease, motor oil and the like. Solvent-based pre-spotting compositions can be formulated with adequate water-borne stain removal. However, it is desirable to utilize an emulsion containing both solvents and water, so as to be able to attack both water-borne and oil-borne stains.

Lately, because of the increased cost of various solvents utilized in solvent-based pre-spotters, there has been great emphasis on lessening the amount of solvent utilized and replacing this with other less expensive components, such as water.

BRIEF DESCRIPTION OF INVENTION

It has been surprisingly found that a pre-spotting composition in the form of an oil-out emulsion can be prepared which has good cleaning, resoil inhibition and sprayability under most conditions encountered in home laundry. This composition comprises a salt selected from various classes of salts, a mixture of nonionic surfactants, this mixture including a small percentage of a sorbitan nonionic composition, solvent and water. These formulations are characterized as being an emulsion which is relatively stable and can be easily redispersed upon shaking to a uniform composition. These compositions are suitable for use both as aerosol compositions and as pump spray or squeeze bottle spray compositions.

OBJECTS AND ADVANTAGES

It is, therefore, the primary object of the present invention to provide an emulsion pre-spotting composition having superior cleaning properties for both oil and water-borne stains, including a relatively low percentage of solvent.

It is a further object of the present invention to provide an emulsion laundry pre-treating composition which can be dispensed both from aerosol and non-aerosol containers.

It is a still further object of the present invention to provide an emulsion pre-treating composition which prevents soil redeposition and aids laundry detergents in removing most commonly encountered soils and stains.

Still further objects and advantages of the composition of the present invention will become more apparent from the following more detailed description thereof.

DETAILED DESCRIPTION OF THE INVENTION

The compositions of the present invention comprise a water-in-oil detergent emulsion to be applied to fabrics as a laundry pre-treating composition comprising from about 1 to about 30% by weight of a salt selected from the group consisting of citrates, gluconates, borates, silicates, phosphates, chlorides, carbonates and mixtures thereof; from about 1 to about 35% by weight of a mixture of (i) about 0.5 to about 5% by weight of a sorbitan nonionic surfactant selected from the group consisting of sorbitan monolaurate, sorbitan monooleate, sorbitan trioleate, and mixtures thereof; and (ii) from about 0.5 to about 30% of at least one other nonionic surfactant, said mixture having an HLB of from 8.5 to 10.5; from about 5 to about 60% by weight of a solvent; and from aout 10 to about 75% by weight water.

The laundry pre-treating compositions of the present invention are water-in-oil emulsions. A water-in-oil emulsion is utilized so that the composition can be effectively contained within metal containers, such as aerosol spray cans, and so that the resulting product, when used, is dispensed as a spray, rather than as a foam. Oil-in-water emulsions spray as foams from aerosol containers and are not acceptable for use as pre-spotting compositions.

The first component of the composition of the present invention is a salt. These salts provide a variety of characteristics to the final product, including low temperature sprayability, reduction of soil redeposition and increased performance, i.e., stain removal for oil and fruit stains. Suitable salts include citrate, gluconate, borate, silicate, phosphate, chloride, carbonate and mixtures of these salts.

Specific salts in the above classes which are particularly preferred include sodium citrate, sodium gluconate, borax, sodium silicate, sodium tripolyphosphate, sodium chloride, sodium sesquicarbonate, sodium carbonate, sodium pyrophosphate, potassium chloride, magnesium chloride, zinc ammonium citrate and mixtures thereof. The most preferred salts are sodium citrate, borax, sodium silicate, sodium tripolyphosphate and sodium pyrophosphate for aerosol-type compositions, as the other salts can create corrosion problems. For non-aerosol compositions, preferred salts include sodium citrate, potassium chloride, sodium chloride, magnesium chloride, and mixtures thereof.

These salts must be present in the composition of the present invention in an amount of about 1% by weight. By and large, the upper limit of salt content is dependent upon the solubility of these salts and can reach as high as 35% for some selected highly water-soluble salts. The preferred amount of salt present in the compositions is from about 1 to 15%, and most preferably from about 1 to 5%. At amounts greater than 5 or 15% for most salts, the increase in the performance is relatively negligible, while the increased cost resulting from the added salt far outweighs any increased benefit. Accordingly, for most applications, less than 15% salt content will be utilized.

The compositions of the present invention also include a mixture of nonionic surfactants. The first component of nonionic surfactant mixture is a sorbitan surfactant, such as sorbitan monolaurate, sorbitan monooleate, sorbitan trioleate, and mixtures thereof. The second component of the nonionic mixture includes the following classes of nonionic surfactants: the ethoxylated nonylphenols, such as the Surfonic N Series available from Jefferson Chemical, the ethoxylated octylphenols, including the Triton X Series available from Rohm & Haas, the ethoxylated secondary alcohols, such as the Tergitol Series available from Union Carbide, the ethoxylated primary alcohol series, such as the Neodols available from Shell Chemical, the polymeric ethylene oxides, such as the Pluronics available from B.A.S.F. Wyandotte, and the ethylene oxide propylene oxide block copolymers, such as the Plurafacs available from B.A.S.F. Wyandotte.

The preferred surfactants include the ethoxylated nonylphenols and the ethoxylated octylphenols, as these materials have excellent oil and water dispersibility, good detergency characteristics and can produce stable oil-out emulsions. The particularly preferred surfactants are nonylphenols having from 3 to 8 moles of ethylene oxide, and particularly, nonylphenol having 6 moles of ethylene oxide combined with a small amount of a nonylphenol reacted with 3.5 moles of ethylene oxide.

As an additional nonionic surfactant, it is often desirable to incorporate a small amount, i.e., from 0.1 to 3% by weight, an ethoxylated sorbitan nonionic, such as those sold under the tradename Tweens from ICI America. Suitable nonionics include ethoxylated sorbitan monolaurate plus 20 moles ethylene oxide, ethoxylated sorbitan monopalmitate with 20 moles ethylene oxide, ethoxylated sorbitan monostearate with 20 moles ethylene oxide, ethoxylated sorbitan monooleate with 20 moles ethylene oxide and mixtures thereof. The Tween-type ethoxylated sorbitan nonionics, when combined with the non-ethoxylated sorbitan nonionics in appropriate amounts, provide excellent emulsion stability, increased stain removal performance and improved inhibition of soil redeposition.

The nonionic mixture must have an HLB of 8.5 to 10.5 to form a stable oil-out emulsion in the composition of the present invention. This HLB range is important so that the emulsion remains as an oil-out emulsion and so that the surfactants have sufficient characteristics so as to attack and be active against both oil and water-borne stains.

The nonionic surfactant mixture should be present in an amount of from about 1 to 35% by weight and preferably from 3 to 25% by weight, and most preferably 5 to 15% by weight. At amounts of below 1% by weight, soil redeposition and cleaning is not acceptable, while above 35% by weight, performance also becomes unacceptable and drops off drastically. Amounts of surfactant in excess of 25% do not the increase performance in an amount perceptible by users, however, the increase in cost can be substantial.

The mixture should include from about 0.5 to 5% sorbitan nonionic and about 0.5 to 30% other nonionic. Preferred mixtures include 0.5 to 2% sorbitan nonionic and 2.0 to 23% other nonionic and most preferred 0.5 to 2% sorbitan nonionic and 4.0 to 13% other nonionic.

The compositions of the present invention also include a hydrocarbon solvent. Suitable hydrocarbon solvents include isoparaffinic hydrocarbons, including mixed $C_{10}$-$C_{12}$ isoparaffinic hydrocarbon sold under the tradename Isopar by Exxon Chemicals, Houston, Tex. These isoparaffinic hydrocarbons are branched chain fully saturated hydrocarbons and are characterized by boiling range. These mixtures are available in boiling ranges of from 98° C. to 210° C. In addition to the isoparaffinic hydrocarbons, low odor petroleum solvent having a boiling range of 195° C. to 250° C., kerosene and d-Limonene also are acceptable. From an odor standpoint, the isoparaffinic hydrocarbons are preferred, as these materials are low odor. However, if odor is not a consideration, substantially any of the above solvents can be utilized.

For a variety of reasons, it is preferred to utilize certain relatively high boiling solvents so that the solvent is in contact for some time with the stain and so that flammability of any product formulated is somewhat reduced. It is preferred to use an isoparaffinic hydrocarbon solvent having a boiling range of from 157° C. to 210° C., and most preferably from 176° C. to 188° C.

The solvents utilized in the composition of the present invention can be present in an amount from 5 to 60% by weight and preferably from 5 to 35% by weight, and most preferably from 5 to 30% by weight. It is most preferable that since solvents are relatively expensive and a petroleum resource, that a minimum amount of solvent be utilized in the composition of the present invention, while at the same time maintaining only stain removal.

The last component of the composition of the present invention is water. Water is the filler or bulk medium and also enables cleaning of water-borne stains. The water is present in an amount of from 10 to 75% by weight and preferably from 40 to 75% by weight.

In addition to the above components, the compositions of the present invention may include a number of other optional ingredients such as perfumes, corrosion inhibitors, defoamers, bactericides, bacteriostats and the like. These materials are generally present in amounts of less than 2% by weight, based on the weight of the composition.

The compositions of the present invention are suitable for use in aerosol compositions. Typical aerosol compositions include from 95 to 80% of the composition of the present invention and 5 to 20% of a propellant. Any of the typical aerosol propellants, such as hydrocarbon, halogenated hydrocarbon and compressed gasses, can be used. Suitable propellants include propane, butane, isobutane, pentane, propellant 11, propellant 12, propellant 14, and the like. Preferred propellants are the hydrocarbon propellants as other propellants may interact with the water to cause corrosion problems.

The prespotting composition of the present invention will now be illustrated by the following examples, wherein all parts and percentages are by weight and all temperatures in degrees Celsius unless otherwise indicated.

EXAMPLE A

An artificial sebum soil was prepared as follows:

| | Weight (Gms) |
|---|---|
| Part A | |
| Palmitic Acid | 5.0 |
| Stearic Acid | 2.5 |
| Coconut Oil | 7.5 |
| Paraffin | 5.0 |
| Spermaceti | 7.5 |
| Olive Oil | 10.0 |
| Squalene | 2.5 |

-continued

| | Weight (Gms) |
|---|---|
| Chloresterol | 2.5 |
| Oleic Acid | 5.0 |
| Linoleic Acid | 2.5 |
| | 50.0 |
| Part B | |
| Oleic Acid | 4.0 gms. |
| Triethanolamine | 8.0 gms. |

Melt all the components of Part A together at 120°–130° F. Add Part B to Part A with agitation while hot until homogeneous. At this time, 12 grams of air filter dirt (+200 mesh) is added and agitated for 10 minutes. From 50–100 ml of 120° F. deionized water is added with agitation and stirred for 10 minutes. From 900–950 ml (to total 1000 ml) of 120° F. deionized water is added and agitated until the temperature of the mixture drops to 110° F. The mixture is agitated in a Gifford Wood Homogenizer for 10 minutes or until 120° F. Pour the mixture through cheesecloth and store in 100° F. oven.

EXAMPLE B

Grass stain slurry is prepared by placing 50 grams of fresh grass clippings and 500 grams of water in a blender and gradually increasing the speed to "liquify". Add isopropyl alcohol as needed (up to 50 grams) to reduce foaming and blend for 20 minutes. Add remainder of isopropyl alcohol (to 50 grams total) and mix for 5 minutes. Strain through a 40 mesh screen and keep refrigerated until use.

EXAMPLE 1

An aerosol prespotting composition having the following composition was prepared:

| Intermediate | |
|---|---|
| Sodium Citrate | 3.0% by weight |
| Nonylphenol Ethoxylate (6 Moles Ethylene Oxide) Surfonic N-60 | 6.0 |
| Nonylphenol Ethoxylate (3.5 Moles Ethylene Oxide) Surfonic N-31.5 | 0.5 |
| Isoparaffinic Hydrocarbon Boiling Range 176° C.–188° C. (Isopar K) | 25.0 |
| Water | 63.4 |
| 75% Solution of Tetramethyl Decynediol in Ethylene Glycol (Surfynol 104 H) Defoamer | 0.1 |
| Sorbitan Monooleate (Span 80) | 0.9 |
| Sorbitan Monooleate Ethoxylate (20 Moles Ethylene Oxide) Tween 80 | 1.1 |
| | 100.0% By Weight |
| Intermediate | 90.0% By Weight |
| Isobutane | 7.0 |
| Pentane | 3.0 |
| | 100.0 |

The intermediate is prepared by mixing the components with agitation. The intermediate is then pressurized with the propellants in an aerosol spray container.

This formulation was tested for sprayability by dispersing the composition at room temperature (23° C.) and after cooling the aerosol container to 5° C. The spray pattern at both temperatures is a fine aerosol spray with no foaming or streaming.

This formulation was also tested on 5 cloth swatches: 100% cotton white, 100% cotton blue, 65/35% polyester/cotton white, 50/50% polyester/cotton white and 100% polyester white. Each white swatch was stained with 8 stains: used motor oil, mustard, grape juice, chocolate, spaghetti sauce, a 20% clay slurry, artificial sebum (Example A) and grass slurry (Example B). The blue cloth was stained with used motor oil, corn oil and butter. The swatches were sprayed with the above formulation for about 2 seconds and allowed to sit for 1 minute. The swatches were washed with Tide Detergent (available from Procter and Gamble) with a dummy load of cotton towels. The formulation had good stain removal on all stains and on all cloth types with a composite rating of 4.0 on a 5 point scale (5 being complete removal).

The formulation was also tested for soil redeposition using the following method:

20 drops of the formulation are placed on a swatch of 100% polyester fabric. A tergotometer is filled with water (3 temperature are used: 140° F., 110° F. and 70° F.) and 0.5 grams of Tide is added. A soiled cloth is added and then the polyester swatch with the prespotter. After the cycle is completed, remove the soiled cloth and polyester swatches. Hold the polyester swatch and pour the wash water through the swatch (to simulate spinning). Rinse and dry. The above formulation had good soil redeposition characteristics, i.e., it showed little tendancy to form a dark spot on the swatch where the prespotter had been and rated 4.0 on a 5 point scale (5 being no soil redeposition).

EXAMPLE 2

A series of compositions were prepared as shown in Table I. These formulations primarily vary the amount of sodium citrate while the relative amount of the other components is the same. The formulations were prepared as in Example 1 and pressurized into aerosol containers using 90% of the formulation and 7% isobutane and 3% propane as in Example 1. These formulations were tested for spray characteristics, stain removal and soil redeposition as in Example 1.

TABLE I

| Components[1] | Run A | B | C | D | E | F | G | H[2] |
|---|---|---|---|---|---|---|---|---|
| Sodium Citrate | 1.0 | 4.9 | 9.3 | 13.4 | 17.1 | 23.6 | 9.2 | 34.0 |
| Surfonic N-60 | 6.1 | 5.9 | 5.6 | 5.4 | 5.1 | 4.7 | 4.4 | 4.1 |
| Surfonic N-31.5 | 0.5 | 0.5 | 0.5 | 0.4 | 0.4 | 0.4 | 0.4 | 0.3 |
| Isopar K | 25.5 | 24.5 | 23.4 | 22.3 | 21.4 | 19.7 | 18.2 | 17.0 |
| Water | 64.8 | 62.1 | 59.3 | 56.6 | 54.2 | 49.9 | 46.2 | 43.2 |
| Surfynol 104 H | 0.1 | 0.1 | 0.1 | 0.1 | 0.1 | 0.1 | 0.1 | 0.1 |
| Span 80 | 0.9 | 0.9 | 0.8 | 0.8 | 0.8 | 0.7 | 0.7 | 0.6 |
| Tween 80 | 1.1 | 1.1 | 1.0 | 1.0 | 0.9 | 0.9 | 0.8 | 0.7 |
| Spray Room Temp. | OK[3] | OK | OK | OK | OK | OK | OK | Plugs |
| 5° C. | Foam | OK | OK | OK | OK | OK | OK | — |
| Stain Removal[4] | 4.0 | 3.5 | 3.0 | 3.0 | 3.0 | 3.0 | 3.5 | 3.5 |
| Redepo- | 3.0 | 4.0 | 4.5 | 4.5 | 4.5 | 4.5 | 4.5 | 4.5 |

TABLE I-continued

| Components[1] | Run A | B | C | D | E | F | G | H[2] |
|---|---|---|---|---|---|---|---|---|
| sition[5] | | | | | | | | |

[1]See Example 1 for Description of Tradename Compositions.
[2]Comparative
[3]OK - Fine Aerosol Spray
[4]Stain Removal - A composite 5 point scale based on 10 stains and 5 fabrics as in Example 1; 1.0 is no removal, 3.0 is the performance of commercial prespotting compositions and 5.0 is complete removal.
[5]Redeposition - A 5 point scale with 1.0 being heavy redeposition and 5.0 being no redeposition.

As is apparent from Table I, at low and high amounts of sodium citrate the performance is not acceptable because of spray problems, stain removal or redeposition.

EXAMPLE 3

A series of formulations, as set forth in Table II, were prepared varying the Surfonic N-60 nonionic surfactant. The formulations were tested as in Example 1.

TABLE II

| Compo- | Run | | | | | | |
|---|---|---|---|---|---|---|---|
| nents[1] | A | B | C | D | E | F[2] | G[2] |
| Sodium Citrate | 3.2 | 2.8 | 2.6 | 2.4 | 2.2 | 2.1 | 1.9 |
| Surfonic N-60 | 1.0 | 9.6 | 17.5 | 24.2 | 29.9 | 34.7 | 39.0 |
| Surfonic N-31.5 | 0.5 | 0.5 | 0.4 | 0.4 | 0.4 | 0.3 | 0.3 |
| Isopar K | 26.3 | 24.0 | 21.9 | 20.2 | 18.6 | 17.4 | 16.2 |
| Water | 66.8 | 61.0 | 55.7 | 51.1 | 47.3 | 44.0 | 41.2 |
| Surfynol 104 H | 0.1 | 0.1 | 0.1 | 0.1 | 0.1 | 0.1 | 0.1 |
| Span 80 | 0.9 | 0.9 | 0.8 | 0.7 | 0.7 | 0.6 | 0.6 |
| Tween 80 | 1.2 | 1.1 | 1.0 | 0.9 | 0.8 | 0.8 | 0.7 |
| Spray - | OK[3] | OK | OK | Foam | Foam | Foam | Foam |
| Room Temp. | | | | | | | |
| 5° C. | OK | OK | OK | Foam | Foam | Foam | Foam |
| Stain Removal[4] | 3.5 | 4.5 | 4.5 | 3.5 | 3.5 | 2.5 | 2.5 |
| Redeposition[5] | 2.0 | 3.5 | 4.0 | 4.0 | 4.0 | 4.0 | 4.0 |

[1-5]Same Meaning as TABLE I

At very high levels of Surfonic N-60, the spray characteristics were poor. Runs D and E had foaming because the surfactant was unbalanced and would be acceptable if the HLB was balanced by other surfactants. The stain removal characteristics are good for all runs except F and G. At low levels of Surfonic N-60, control of redeposition is poor.

EXAMPLE 4

A series of formulations were prepared as shown in Table III varying the solvent level. The formulations were tested as in Example 1.

TABLE III

| Components[1] | Run A | B | C | D | E | F[2] | G | H |
|---|---|---|---|---|---|---|---|---|
| Sodium Citrate | 3.5 | 2.6 | 1.9 | 3.6 | 3.8 | 3.9 | 1.9 | 1.7 |
| Surfonic N-60 | 7.1 | 5.2 | 3.9 | 7.3 | 7.5 | 7.7 | 3.9 | 3.4 |
| Surfonic N-31.5 | 0.6 | 0.4 | 0.3 | 0.6 | 0.6 | 0.6 | 0.3 | 0.3 |
| Isopar K | 11.8 | 34.8 | 38.7 | 9.1 | 6.3 | 3.3 | 51.6 | 57.1 |
| Water | 74.5 | 55.1 | 40.8 | 76.9 | 79.2 | 81.8 | 40.9 | 36.3 |
| Surfynol 104 H | 0.1 | 0.1 | 0.1 | 0.1 | 0.1 | 0.1 | 0.1 | 0.1 |
| Span 80 | 1.1 | 0.8 | 0.6 | 1.1 | 1.1 | 1.2 | 0.6 | 0.5 |
| Tween 80 | 1.3 | 1.0 | 0.7 | 1.3 | 1.4 | 1.4 | 0.7 | 0.6 |
| Spray Room Temp. | OK[3] | OK | OK | Slight | Slight | Foam | OK | OK |
| 5° C. | OK | OK | OK | OK | OK | OK | OK | OK |
| Stain Removal[4] | 4.0 | 3.5[6] | 3.5[6] | 4.0 | 4.0 | 2.5 | 3.0[6] | 3.0[6] |
| Redeposition[5] | 4.5 | 2.0 | 2.5 | 4.5 | 4.5 | 4.5 | 2.0 | 2.0 |

[1-5]Same Meaning as TABLE I
[6]Less Effective on "Water-Borne Stains"

At high solvent levels, the redeposition inhibition is poor and the stain removal on water-borne stains is not as good. The slight foaming in Runs D and E could be eliminated by small changes in the formulation, such as surfactant modification.

EXAMPLE 5

A series of formulations were prepared as shown in Table IV by varying the water content. The formulations were tested as in Example 1, except that a soil redeposition study was not done.

TABLE IV

| Components[1] | Run A[2] | B[2] | C | D | E | F | G | H | I |
|---|---|---|---|---|---|---|---|---|---|
| Sodium Citrate | 6.4 | 5.3 | 4.5 | 3.9 | 3.5 | 2.8 | 2.6 | 2.4 | 2.2 |
| Surfonic N-60 | 12.9 | 10.6 | 9.0 | 7.8 | 6.9 | 5.6 | 5.1 | 4.7 | 4.4 |
| Surfonic N-31.5 | 1.1 | 0.9 | 0.8 | 0.7 | 0.6 | 0.5 | 0.4 | 0.4 | 0.4 |
| Isopar K | 53.6 | 44.2 | 37.4 | 32.6 | 28.9 | 23.5 | 21.4 | 19.7 | 18.3 |
| Water | 21.5 | 35.3 | 45.0 | 52.3 | 57.7 | 65.8 | 68.7 | 71.1 | 73.1 |
| Surfynol 104 H | 0.2 | 0.2 | 0.2 | 0.1 | 0.1 | 0.1 | 0.1 | 0.1 | 0.1 |
| Span 80 | 1.9 | 1.6 | 1.4 | 1.2 | 1.0 | 0.8 | 0.8 | 0.7 | 0.7 |
| Tween 80 | 2.4 | 1.9 | 1.7 | 1.4 | 1.3 | 1.0 | 0.9 | 0.9 | 0.8 |
| Spray Room Temp. | OK[3] | OK | OK | OK | OK | OK | OK | OK | OK |
| 5° C. | Stream | Stream | OK | OK | OK | OK | OK | OK | OK |
| Stain Removal[4] | 3.5[6] | 3.5[6] | 3.5[6] | 3.5[6] | 4.0 | 4.0 | 4.0 | 4.0 | 3.5 |

[1-4]Same Meaning as in TABLE I
[6]Less Effective on "Water-Borne Stains"

Water levels have little effect on overall performance, except that at low levels (Runs A and B), spray characteristics at low temperatures are not acceptable. Redeposition studies were not done, but formulations with higher water content generally show better inhibition of redeposition.

EXAMPLE 6

A series of formulations were prepared as shown in Table V varying the Span 80 content. The formulations were tested as in Example 1.

TABLE V

| Components[1] | Run A | B | C | D | E[2] | F[2] | G[2] | H[2] |
|---|---|---|---|---|---|---|---|---|
| Sodium Citrate | 3.0 | 3.0 | 2.9 | 2.9 | 2.7 | 2.5 | 2.8 | 2.8 |
| Surfonic N-60 | 6.0 | 6.0 | 5.9 | 5.8 | 5.5 | 5.0 | 5.7 | 5.6 |
| Surfonic N-31.5 | 0.5 | 0.5 | 0.5 | 0.5 | 0.5 | 0.4 | 0.5 | 0.5 |
| Isopar K | 25.3 | 25.2 | 24.5 | 24.0 | 22.9 | 21.0 | 23.4 | 23.1 |
| Water | 63.9 | 63.8 | 62.1 | 60.8 | 58.1 | 53.3 | 59.9 | 58.6 |
| Surfynol 104 H | 0.1 | 0.1 | 0.1 | 0.1 | 0.1 | 0.1 | 0.1 | 0.1 |
| Span 80 | 0.1 | 0.3 | 2.9 | 4.8 | 9.2 | 16.8 | 6.6 | 8.3 |
| Tween 80 | 1.1 | 1.1 | 1.1 | 1.1 | 1.0 | 0.9 | 1.0 | 1.0 |
| Spray Room Temp. | OK[3] | OK | OK | OK | 6 | 6 | OK | OK |
| 5° C. | Foam | Foam | OK | OK | 6 | 6 | OK | Stream |
| Stain Removal[4] | 4.0 | 4.0 | 3.0 | 2.5 | 0.0 | 0.0 | 1.0 | 1.0 |
| Redeposition[5] | 3.5 | 3.5 | 4.0 | 3.0 | — | — | — | — |

[1-5]Same Meaning as in TABLE I
[6]Thick White Emulsion - Difficult to Spray

At levels of Span 80 above 5%, the performance and spray characteristics are poor.

EXAMPLE 7

A series of formulations were prepared as shown in Table VI, varying the Tween 80 content. The formulations were tested as in Example 1.

TABLE VI

| Components[1] | Run A | B | C | D[2] | E |
|---|---|---|---|---|---|
| Sodium Citrate | 3.0 | 3.0 | 2.9 | 2.9 | 3.0 |
| Surfonic N-60 | 6.1 | 6.1 | 5.9 | 5.8 | 6.1 |
| Surfonic N-31.5 | 0.5 | 0.5 | 0.5 | 0.5 | 0.5 |
| Isopar K | 25.3 | 25.2 | 24.5 | 24.0 | 25.3 |
| Water | 64.0 | 63.9 | 62.3 | 61.0 | 64.1 |
| Surfynol 104 H | 0.1 | 0.1 | 0.1 | 0.1 | 0.1 |
| Span 80 | 0.9 | 0.9 | 0.9 | 0.9 | 0.9 |
| Tween 80 | 0.1 | 0.3 | 2.9 | 4.8 | — |
| Spray Room Temp. | OK[3] | OK | OK | OK | OK |
| 5° C. | OK | OK | OK | OK | OK |
| Stain Removal[4] | 3.0 | 3.5 | 3.0 | 2.0 | 3.0 |
| Redeposition[5] | 2.0 | 2.0 | 3.0 | 3.0 | 2.0 |

[1-5]Same Meaning as in TABLE I

From the performance and redeposition results, this example shows the importance of balancing the Span and Tween levels to achieve proper performance, if Tweens are present in the formulation.

EXAMPLE 8

The formulation of Example 1 was prepared, except that the following salts were substituted for the sodium citrate:

(a) Zinc Ammonium Citrate
(b) Sodium Gluconate
(c) Borax with 5 Moles of Water of Hydration
(d) Sodium Silicate
(e) Sodium Tripolyphosphate
(f) Sodium Chloride
(g) Sodium Sesquicarbonate
(h) Sodium Carbonate
(i) Sodium Pyrophosphate
(j) Potassium Chloride
(k) Magnesium Chloride These formulas were tested as in Example 1 and had good spray characteristics and equivalent or better performance. The chlorides, in particular, had better stain removal than sodium citrate.

EXAMPLE 9

The formulation of Example 1 was repeated, except that the following solvents were substituted in place of the Isopar K:

(a) Isopar C (Isoparaffinic Hydrocarbon, Boiling Range 97°-107° C.)
(b) Isopar G (Isoparaffinic Hydrocarbon, Boiling Range 156°-176° C.)
(c) Conoco LPA (A Low Odor Parafin Solvent Deodorized Kerosene, Boiling Range 195°-250° C.)
(d) d-Limonene
(e) Deodorized Kerosene All had good spray characteristics and equal or better soil removal and redeposition characteristics compared to Example 1.

EXAMPLE 10

The formulation of Example 1 was repeated, except the Surfonic N-60 was replaced by the following surfactants:

(a) Triton X-45 (Octylphenol Ethoxylate—4.5 Moles Ethylene Oxide)
(b) Tergitol 15-S-5 (Secondary $C_{11}$-$C_{15}$ Alcohol Ethoxylate—5 Moles Ethylene Oxide)
(c) Neodol 25-7 (Primary $C_{12}$-$C_{15}$ Alcohol Ethoxylate—7 Moles Ethylene Oxide)
(d) Neodol 91-6 (Primary $C_9$-$C_{11}$ Alcohol Ethoxylate—6 Moles Ethylene Oxide)
(e) Plurafac D-25[1] (Modified Oxyethylated Straight Chain Alcohol)
(f) Pluronic L63[1] (Condensate of Ethylene Oxide with a Condensation of Propylene Oxide and Propylene Glycol)

1-Proprietary materials of B.A.S.F. Wyandotte.

The results with the Triton and Tergitol were equal to Example 1. The others formed water-out emulsions and had poor stain and spray characteristics. An adjustment of the HLB, by adding a further surfactant, will yield acceptable results.

What we claim is:

1. A water-in-oil detergent emulsion to be applied to fabrics as a laundry pre-spotting composition comprising:

(a) from about 1 to about 30% by weight of a salt selected from the group consisting of citrates, gluconates, borates, silicates, phosphates, chlorides, carbonates and mixtures thereof;

(b) from about 1 to about 35% by weight of a surfactant mixture of (i) about 0.5 to about 5% by weight of a sorbitan nonionic surfactant selected from the group consisting of sorbitan monolaurate, sorbitan monooleate, sorbitan trioleate and mixtures thereof; (ii) from about 0.5 to about 30% of at least one other nonionic surfactant; and (iii) from about 0.5 to 3.0% by weight, of an ethoxylated sorbitan nonionic surfactant, said mixture having an HLB of from 8.5 to 10.5;

(c) from about 5 to about 60% by weight of a solvent selected from the group consisting of isoparaffinic hydrocarbons having a boiling range of from 98°-210° C., low odor petroleum solvents having a boiling range of from 195°-250° C., kerosene, d-Limonene and mixtures thereof; and (d) the balance water.

2. The composition of claim 1 wherein the salt is selected from the group consisting of sodium citrate, sodium gluconate, borax, sodium silicate, sodium tripolyphosphate, sodium chloride, sodium sesquicarbonate, sodium carbonate, sodium pyrophosphate, potassium chloride, magnesium chloride and mixtures thereof.

3. The composition of claim 1 wherein the salt is present in an amount of from 1 to 15% by weight.

4. The composition of claim 1 wherein the salt is present in an amount from 1 to 5% by weight.

5. The composition of claim 1 wherein the other nonionic surfactant is selected from the group consisting of ethoxylated nonylphenol, ethoxylated octaphenols, ethoxylated secondary alcohols, ethoxylated primary alcohols, polymeric ethylene oxides and polymeric ethylene oxide propylene oxide block copolymers and mixtures thereof.

6. The composition of claim 1 wherein the surfactant mixture is present in an amount of from 3 to 25% by weight.

7. The composition of claim 1 wherein the surfactant mixture is present in an amount of from 5 to 15% by weight.

8. The composition of claim 6 wherein the surfactant mixture includes from about 0.5 to 2% sorbitan nonionic about 2.0 to 23% by weight of other nonionic and about 0.5 to 2% by weight of ethoxylated sorbitan nonionic.

9. The composition of claim 7 wherein the surfactant mixture contains from 0.5 to 2% sorbitan nonionic and 4.0 to 13% by weight of other nonionic and about 0.5 to 2% by weight of ethoxylated sorbitan nonionic.

10. The composition of claim 1 wherein the solvent is an isoparaffinic hydrocarbon having a boiling range of from 157°-210° C.

11. The composition of claim 1 wherein the solvent is present in an amount of from 5 to 35% by weight.

12. The composition of claim 1 wherein the solvent is present in an amount of from 5 to 30% by weight.

13. The composition of claim 1 wherein the water is present in an amount of from about 40 to 75% by weight.

14. A water-in-oil detergent emulsion to be applied to fabrics as a laundry pre-treating composition comprising:

(a) from about 1 to 15% by weight of a salt selected from the group consisting of citrates, gluconates, borates, silicates, phosphates, chlorides, carbonates and mixtures thereof;

(b) from about 3 to 25% by weight of a mixture of:

(i) from about 0.5 to about 2% by weight of a sorbitan nonionic surfactant selected from the group consisting of sorbitan monolaurate, sorbitan monooleate, sorbitan trioleate and mixtures thereof;

(ii) from about 2.0 to 23% by weight of a nonionic selected from the group consisting of ethoxylated nonylphenols, ethoxylated octaphenols, ethoxylated secondary alcohols, ethoxylated primary alcohols, ethylene oxide polymers, ethylene oxide propylene oxide copolymers and mixtures thereof; and (iii) from about 0.5 to about 2% by weight of an ethoxylated sorbitan nonionic selected from the group consisting of ethoxylated sorbitan monolaurate with 20 moles ethylene oxide, ethoxylated sorbitan monopalmitate with 20 moles ethylene oxide, ethoxylated sorbitan monostearate with 20 moles ethylene oxide, ethoxylated sorbitan monoleate with 20 moles ethylene oxide and mixtures thereof; the nonionic mixture having an HLB of 8.5 to 10.5;

(c) from about 5 to about 35% by weight of a solvent selected from the group consisting of isoparaffinic hydrocarbons having a boiling range of from 98°-210° C., low odor petroleum solvents having a boiling range of from 195°-250° C., kerosene, d-Limonene and mixtures thereof; and (d) the balance water.

15. The composition of claim 1 wherein 95 to 80% by weight of said composition is mixed with from 5 to 20% by weight of a propellent and said composition is packaged in a pressurized aerosol container.

16. A water-in-oil detergent emulsion to be applied to fabrics as a laundry pre-spotting composition contained in a pressurized aerosol container comprising from 95 to 80% by weight of a composition comprising:

(a) from about 1 to about 30% by weight of a salt selected from the group consisting of citrates, gluconates, borates, silicates, phosphates, chlorides, carbonates and mixtures thereof;

(c) from about 1 to about 35% by weight of a surfactant mixture of (i) about 0.5 to about 5% by weight of a sorbitan nonionic surfactant selected from the group consisting of sorbitan monolaurate, sorbitan monooleate, sorbitan trioleate and mixtures thereof; and (ii) from about 0.5 to about 30% of at least one other nonionic surfactant, said mixture having an HLB of from 8.5 to 10.5;

(c) from about 5 to about 60% by weight of a solvent selected from the group consisting of isoparaffinic hydrocarbons having a boiling range of from 98°-210° C., low odor petroleum solvents having a boiling range of from 195°-250° C., kerosene, d-Limonene and mixtures thereof; and (d) the balance water and from 5 to 20% by weight of a propellent.

* * * * *

UNITED STATES PATENT AND TRADEMARK OFFICE

CERTIFICATE OF CORRECTION

PATENT NO. : 4,438,009

DATED : March 20, 1984

INVENTOR(S) : Jeanne A. Brusky and Rodney W. Schrader

It is certified that error appears in the above-identified patent and that said Letters Patent is hereby corrected as shown below:

Column 2, line 21 - the word "aout" should be --about--.

Column 4, line 26 - the word "only" should be --oily--.

Column 5, line 52 - the underscore should be under line 54.

Column 6, line 51 - the "9.2" under heading G should read --29.2--.

Column 12, line 50 - "c" should be --b--.

Signed and Sealed this

*Third* Day of *July 1984*

[SEAL]

*Attest:*

GERALD J. MOSSINGHOFF

*Attesting Officer*

*Commissioner of Patents and Trademarks*